US006994034B2

(12) United States Patent
Chang

(10) Patent No.: US 6,994,034 B2
(45) Date of Patent: Feb. 7, 2006

(54) FOLDABLE COMPUTER DESK

(76) Inventor: Wu-De Chang, No. 27, Alley 43, Lane 192, Sec. 1, Dong-Shan Rd., Tai-Chung City (TW)

( * ) Notice: Subject to any disclaimer, the term of this patent is extended or adjusted under 35 U.S.C. 154(b) by 339 days.

(21) Appl. No.: 10/379,336

(22) Filed: Mar. 4, 2003

(65) Prior Publication Data

US 2004/0173124 A1 Sep. 9, 2004

(51) Int. Cl.
*A47B 3/00* (2006.01)

(52) U.S. Cl. ..... 108/115; 108/179

(58) Field of Classification Search ..... 108/162, 108/166, 175, 115, 128, 179, 119, 177
See application file for complete search history.

(56) References Cited

U.S. PATENT DOCUMENTS

| | | | | | |
|---|---|---|---|---|---|
| 1,039,694 | A | * | 10/1912 | Burton | 108/163 |
| 1,158,212 | A | * | 10/1915 | Henderson | 108/115 |
| 3,322,077 | A | * | 5/1967 | Kovacik | 108/163 |
| 3,527,174 | A | * | 9/1970 | Lay | 108/115 |
| 4,151,803 | A | * | 5/1979 | Ferrera et al. | 108/41 |
| 4,271,766 | A | * | 6/1981 | Schmiedeler | 108/179 |
| 5,882,098 | A | * | 3/1999 | Brown et al. | 312/258 |
| 5,904,104 | A | * | 5/1999 | Yu | 108/116 |
| 6,698,364 | B2 | * | 3/2004 | Welch et al. | 108/115 |
| 6,817,302 | B2 | * | 11/2004 | Norstad | 108/115 |

FOREIGN PATENT DOCUMENTS

GB 2068215 A * 8/1981

* cited by examiner

*Primary Examiner*—Jose V. Chen
(74) *Attorney, Agent, or Firm*—Charles E. Baxley

(57) ABSTRACT

A computer desk includes a foldable frame and a plurality of desk boards. The desk boards are pivotally connected to the frame and can be folded for storage and unfolded and moved to a horizontal position for use.

13 Claims, 9 Drawing Sheets

FOLDABLE COMPUTER DESK

BACKGROUND OF THE INVENTION

1. Field of the Invention

The present invention relates to a computer desk, more particularly to a computer desk having several shelves and featuring a foldable structure design, so that the desk can be folded to reduce the space for storage and transportation.

2. Description of the Related Art

As computer equipments change day after day, all kinds of new computer desks are introduced to the market. The more peripherals of a computer, the larger space is required for a computer desk. Therefore, a computer desk having several shelves is born. The volume of such computer desk is much larger than that of a simple computer desk having a desktop and legs only. Manufacturers usually disassemble a computer desk into parts to reduce the space for storage and transportation, and pack the components required for the assembly into a package. After buying such computer desk, consumers assemble the desk by themselves. Although such arrangement can reduce the space for storage and transportation, it makes the quality control operation more complicated. If by any chance, the package comes with a missing part, then it is unable to complete the assembling. Furthermore, whether or not a consumer having the time and the ability to assemble the DIY furniture becomes a cause that affects the sales.

SUMMARY OF THE INVENTION

The primary objective of the present invention is to provide a foldable computer desk that will become a flat form after being folded, and allow a stable horizontal stacking in a flat carton for packaging to reduce spaces for storage and transportation. All structural parts and components of the computer desk are completely coupled with each other, and thus eliminating the trouble of disassembling the desk into several structural parts and then assembling them into a desk as the prior art technology. Furthermore, the present invention can avoid any missing part in the package that makes the assembling impossible. The consumer buying this kind of computer desk no longer needs to take time and effort to assemble the desk, but just unfolds the desk for use, which is very simple and convenient.

To achieve the above objectives, the technical measures taken for this invention comprises:

a rear frame, being a rectangular vertical frame;

two side frames, each with its bottom propped on the ground, a plurality of movable axles for coupling a rear edge of said side frame to said rear frame, such that said side frame being folded in the front of said rear frame and unfolded on the left and right sides in front of said rear frame;

a plurality of desk boards, both of its rear ends being pivotally coupled to said rear frame with two movable axles and each desk board being lifted and leaning against the front of said rear frame, and horizontally unfolded between said two side frames;

a plurality of desk board supporting components, each having a plurality of latches at its bottom proximate to its left and right sides and a plurality of protruded ears at its sides corresponding to said two side frames; and a plurality of side rack boards, with one end pivotally coupled to said two side frames, such that said side rack board being lifted to a position proximate said two side frames, and unfolded horizontally between said desk boards;

and a supporting structure being disposed between the unfolded side rack board and its adjacent desk board.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
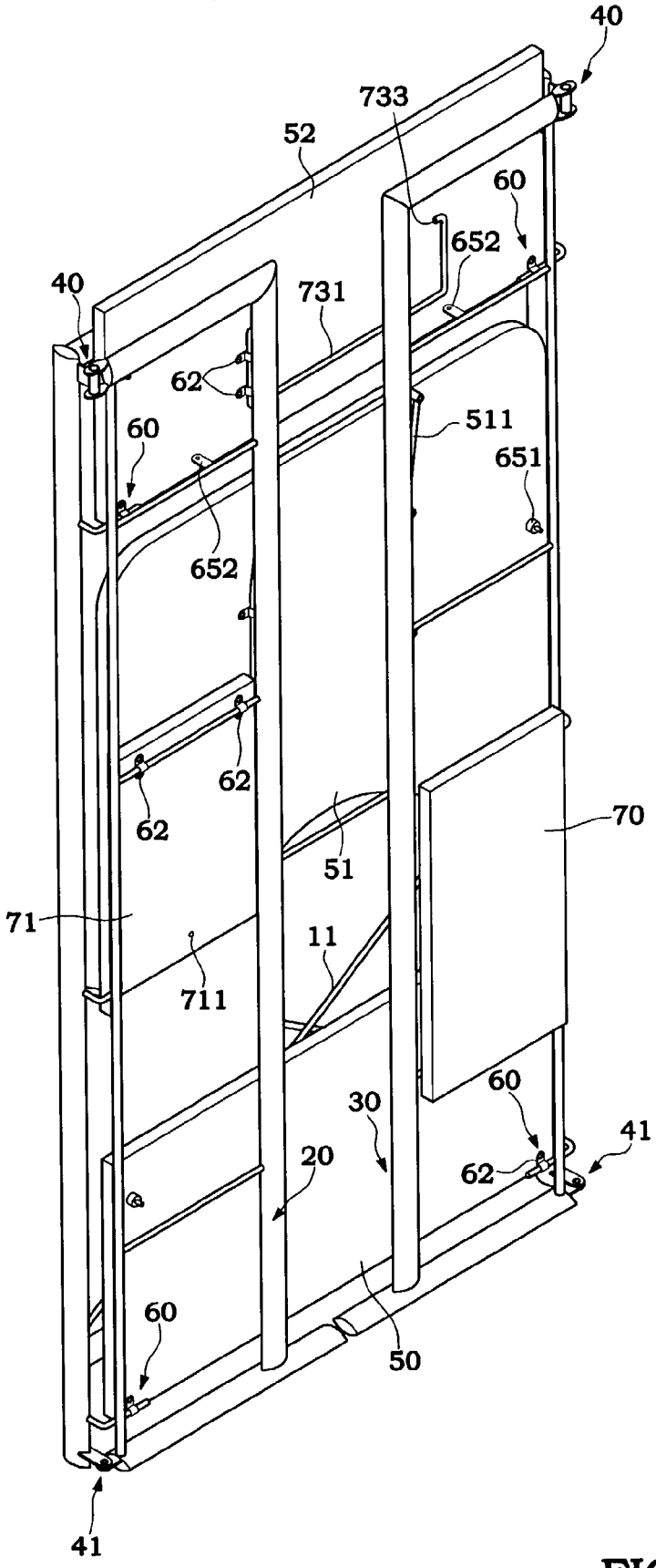
FIG. 1 is a perspective diagram of the folded computer desk according to the present invention.
Figure 2:
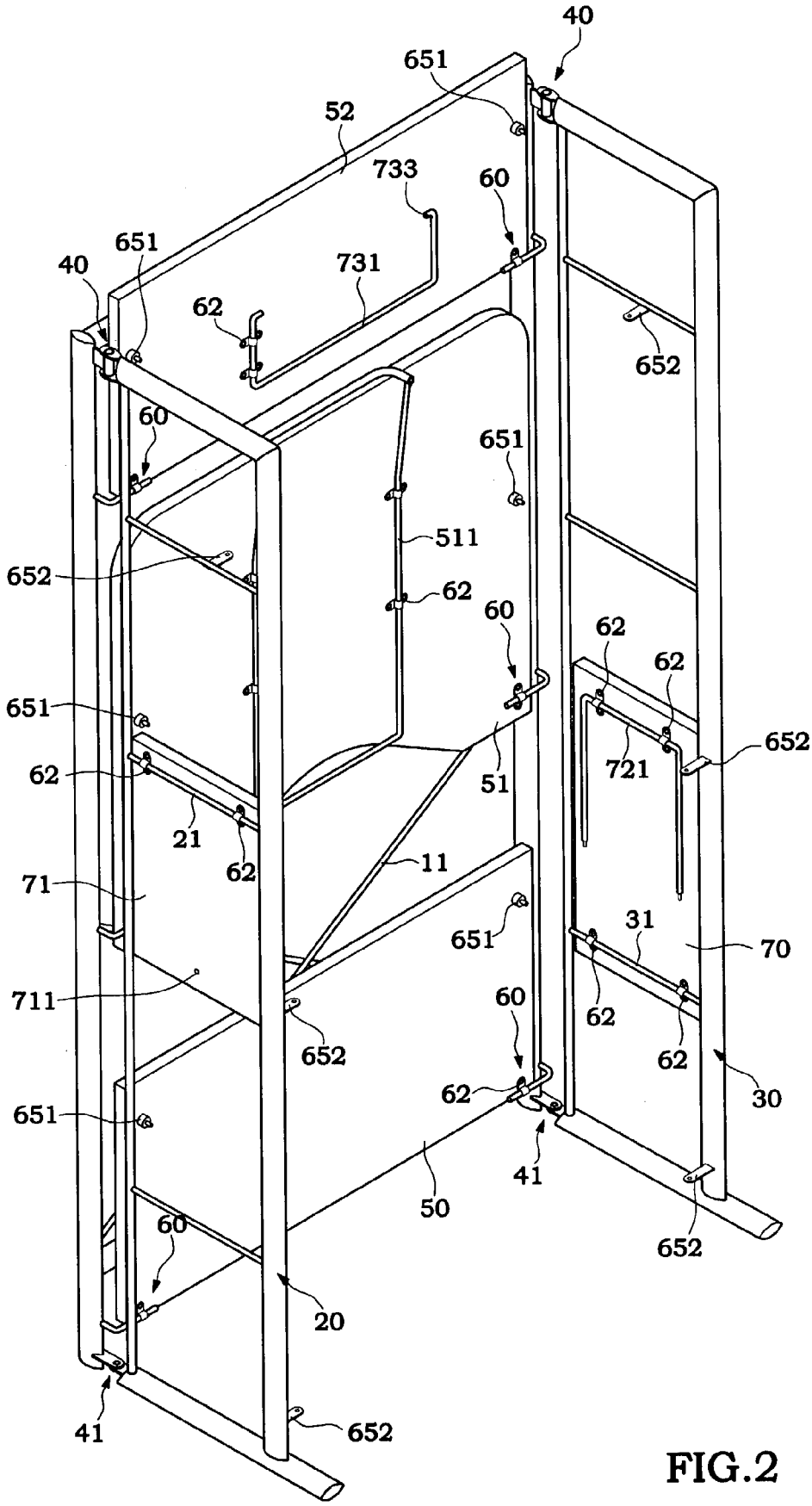
FIG. 2 is a first illustrative diagram of unfolding the foldable computer desk according to the present invention.
Figure 3:
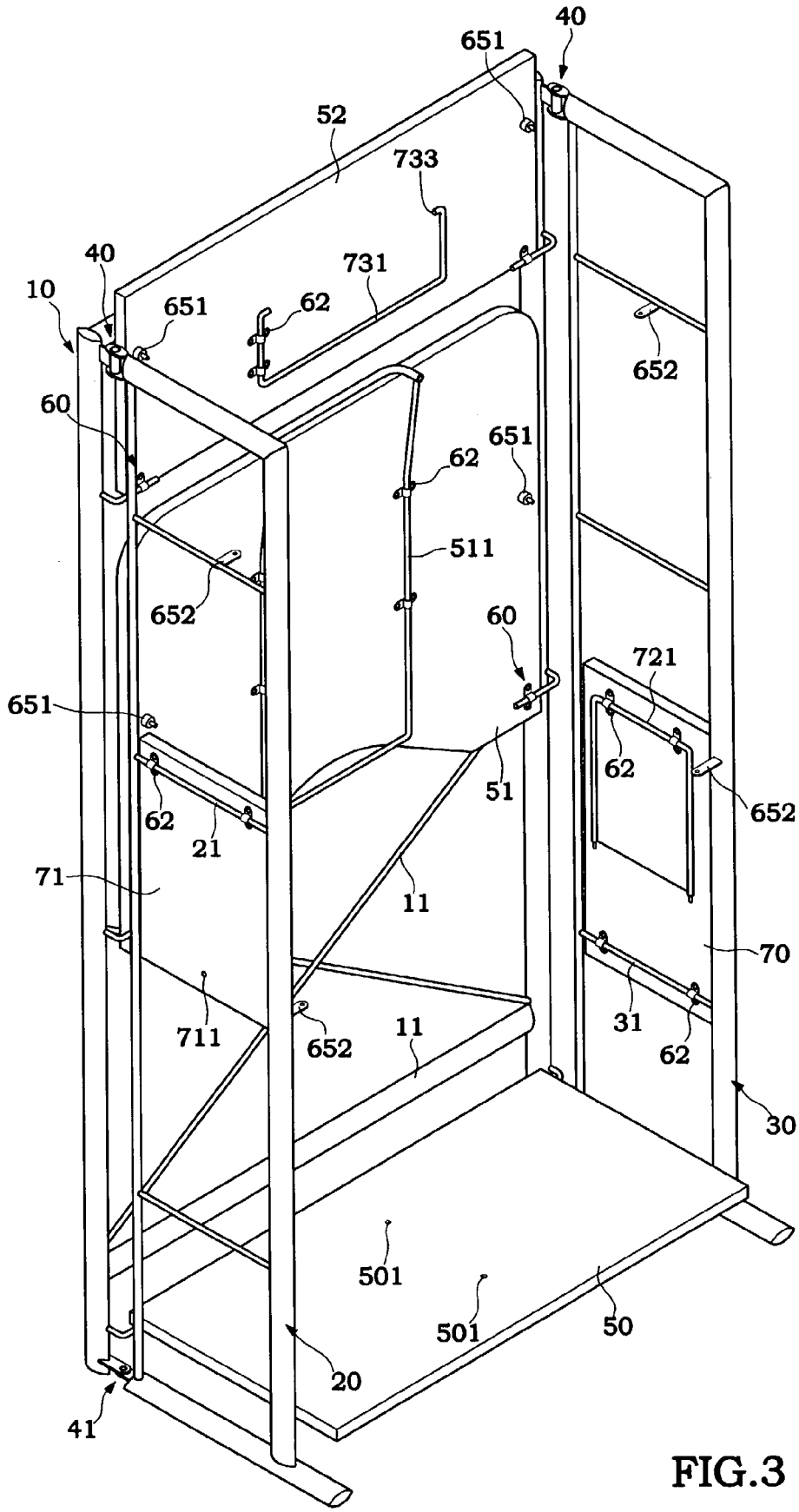
FIG. 3 is a second illustrative diagram of unfolding the foldable computer desk according to the present invention.
Figure 4:
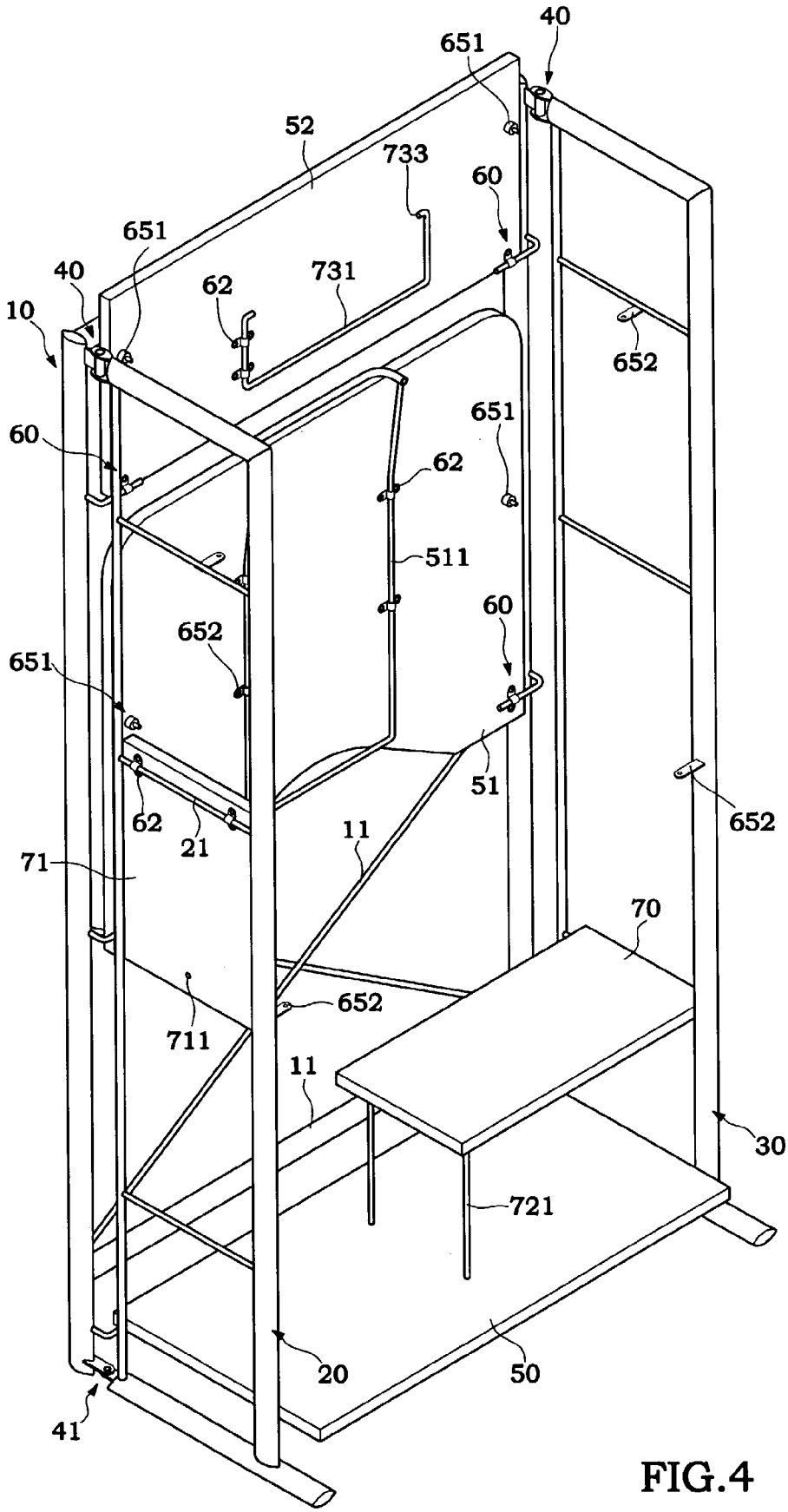
FIG. 4 is a third illustrative diagram of unfolding the foldable computer desk according to the present invention.
Figure 5:
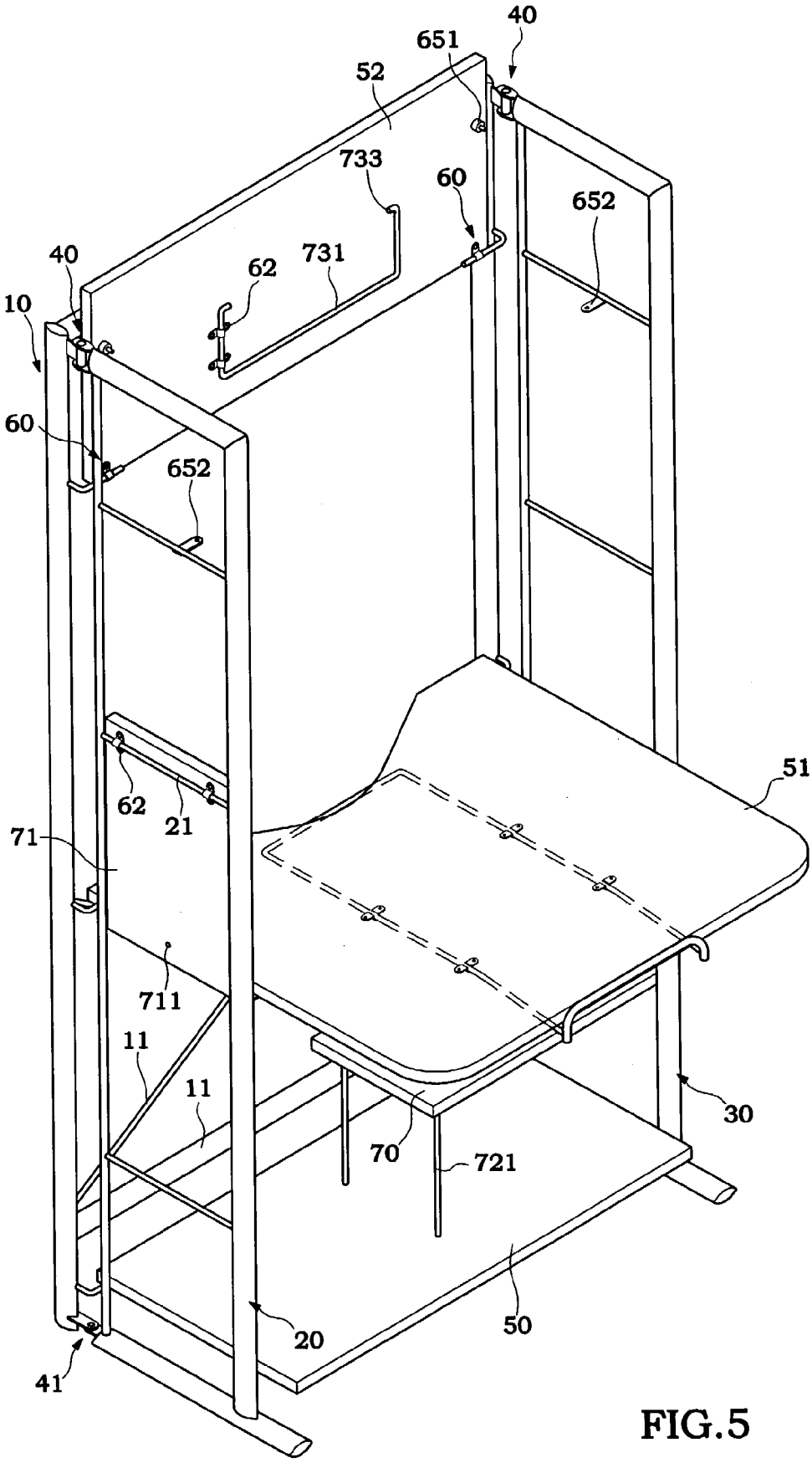
FIG. 5 is a fourth illustrative diagram of unfolding the foldable computer desk according to the present invention.
Figure 6:
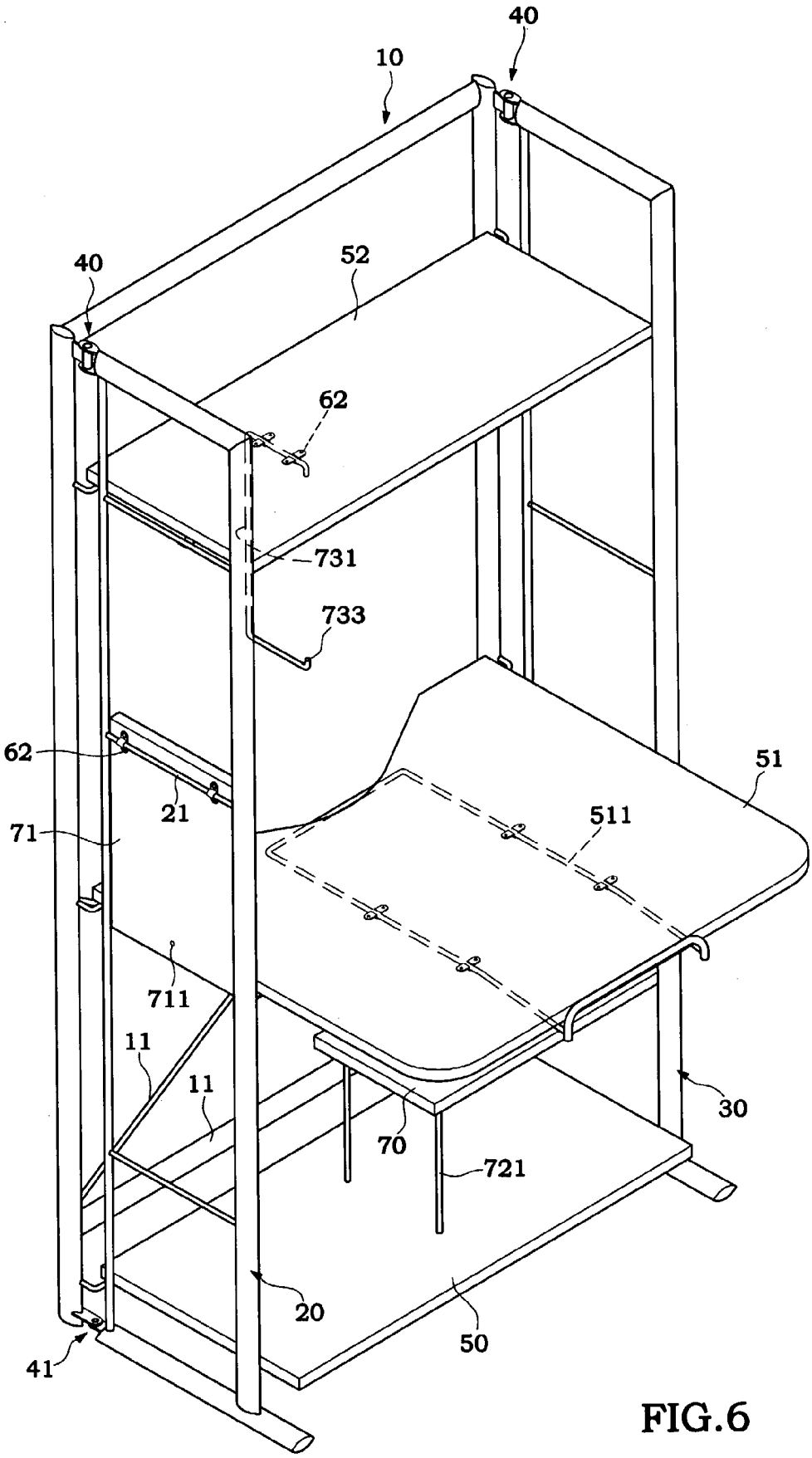
FIG. 6 is a fifth illustrative diagram of unfolding the foldable computer desk according to the present invention.
Figure 7:
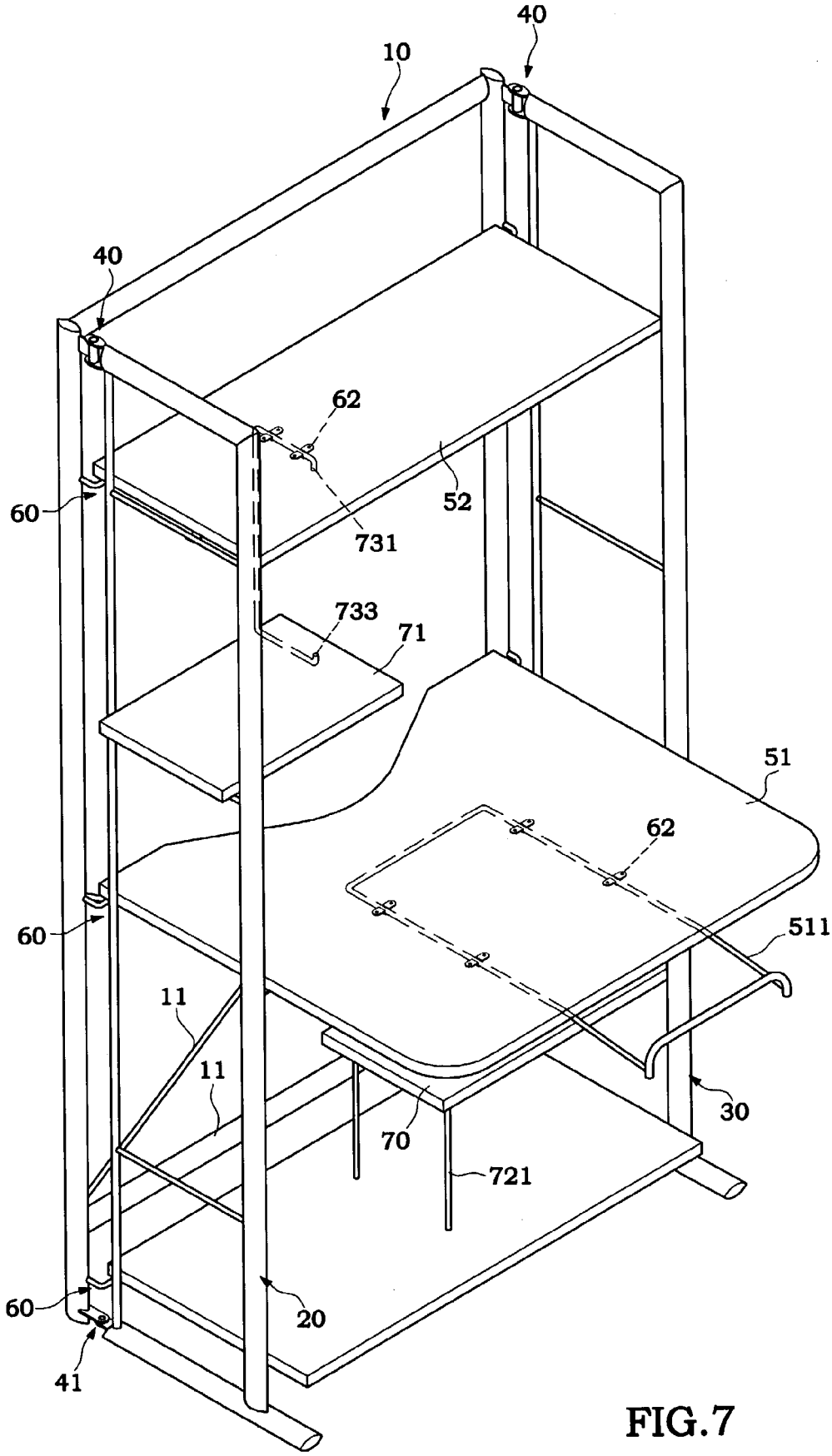
FIG. 7 is a perspective diagram of the unfolded computer desk according to the present invention.
Figure 8:
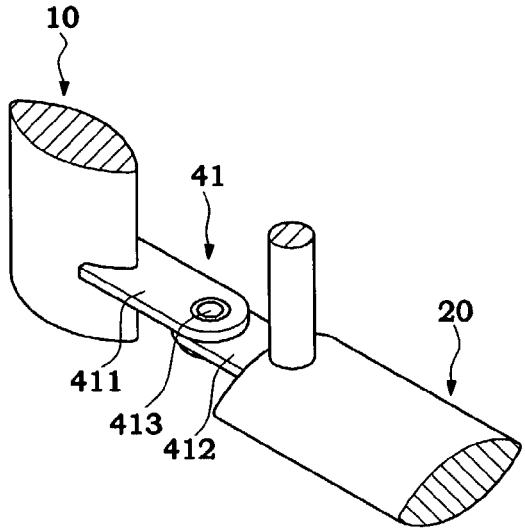
FIG. 8 is a perspective diagram of the side frame and the movable axle of the rear frame according to the present invention.
Figure 9:
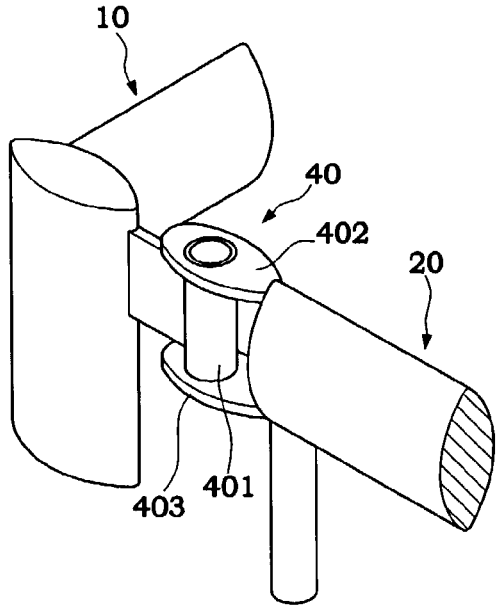
FIG. 9 is a perspective diagram of the side frame and another movable axle of the rear frame according to the present invention.
Figure 10:
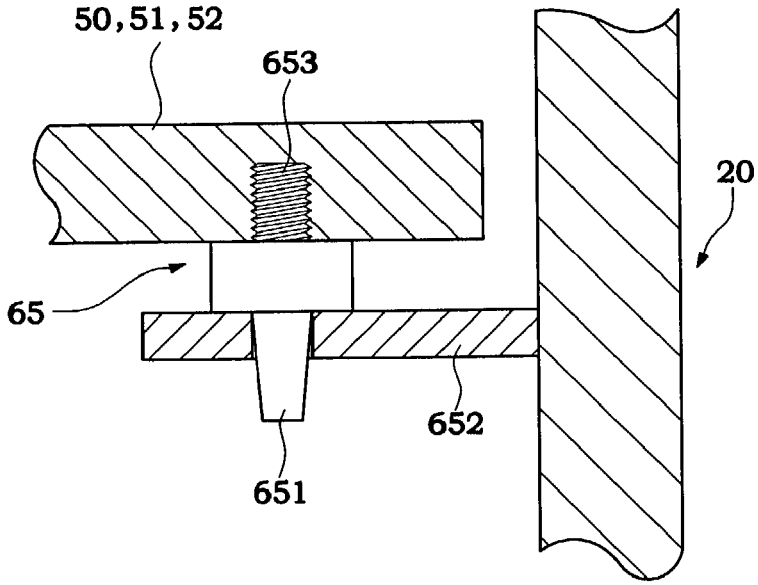
FIG. 10 is an illustrative diagram of the connection between the latch and the protruded ear according to the present invention.
Figure 11:
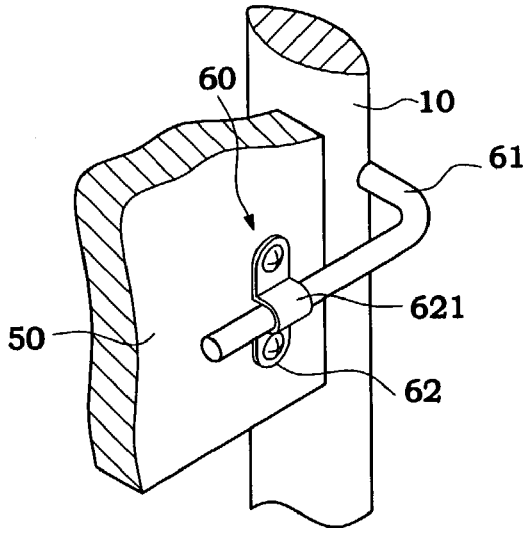
FIG. 11 is a perspective diagram of the desk board and the movable axle of the rear frame according to the present invention.

The foldable computer desk of the present invention, comprises:

a rear frame 10, as shown in FIG. 7, being a rectangular vertical frame, and having a reinforced rod 11 disposed in the frame wither several different configurations to enhance the strength and supportability of the rear frame 10;

two side frames 20, 30, as shown in FIGS. 1 and 2, each with its bottom propped on the ground, and a plurality of movable axles 40, 41 for coupling a rear edge of said side frame 20, 30 with said rear frame 10, such that said side frame 20, 30 being folded in the front of said rear frame 10 and unfolded on the left and right sides in front of said rear frame 10; said movable axle 40 as shown in FIG. 9 having a rotary axle 401 disposed on the corresponding side of said rear frame 10 and said side frame 20, 30 and a pair of clipping plates 402, 403 coupled to both ends of said rotary axle 401, and rotating about said rotary axle 401 to achieve the purpose of folding and unfolding the two side frames 20, 30. Further, in FIG. 8, said movable axle 41 could have a connecting plate 411, 412 extended from the corresponding sides of said rear frame 10 and side frames 20, 30, and the two connecting plates overlying one on top of the other and comprising a penetrating axle 413, such that the connecting plate 412 connected to the side frame 20, 30 being capable of rotating about the penetrating axle 413 to achieve the purpose of folding and unfolding the two side frames 20, 30;

a plurality of desk boards 50, 51, 52, as shown in FIGS. 2 and 7, with both ends of its rear edge coupled to said rear frame 10, and each desk board 50, 51, 52 being separated from each other with a predetermined distance, and using said movable axle 60 to lift up each desk board to lean against the front of said rear frame 10, or unfolded horizontally between two side frames 20, 30; said movable axle 60 as shown in FIG. 11 comprising two axle rods 61 disposed on said rear frame 10 and a plurality of ear plates 62 disposed at the bottom of the desk boards 50, 51, 52, and said ear plate 62 at its center having a hollow protrusion 621 for letting said axle rod 61 pass through; when the desk board being unfolded, said ear plate 62 rotating around said axle rod 61, wherein a keyboard tray 511 disposed in the central position of the bottom of the desk board for moving back and forth;

a plurality of desk board supporting members 65 as shown in FIGS. 2 and 10, being a component for keeping the desk board in an unfolded horizontal position; said supporting member 65 comprising a plurality of latches 651 and a plurality of protruded ears 652, and said latch 651 at one end having a threaded section 653 inversely coupled to the bottom of the desk board 50, 51, 52, and said protruded ear 652 being disposed on a horizontal position with respect to the two corresponding side frames 20, 30; when the desk board 50, 51, 52 being unfolded to a horizontal position, said latch 651 being inserted into said protruded ear 652 to support the open end of said desk board;

a plurality of side rack boards 70, 71 as shown in FIGS. 2, and 7, with one end pivotally coupled to two side frames, so that said side rack boards 70, 71 being lifted and leaning against said two side frames 20, 30 or being unfolded horizontal between said side rack boards 70, 71 and its adjacent desk board 50, 51, 52 and having a supporting structure; the structure of said structure for pivotally coupling said side rack board with said two side frames 20, 30 comprising a transversal rod 21, 31 on said two side frames 20, 30, and a plurality of ear plates 62 with a protrusion 621 at its center disposed at the bottom of said side rack board 70, 71 for letting said transversal rod 21, 31 pass through; when said side rack board 70, 71 being unfolded, said ear plate 62 rotating around said transversal rod 21, 31; the supporting structure as shown in FIGS. 2, 3, and 4, being a rod body with a U-shape supporting stand 721 pivotally passing through the ear plate 62 with a plurality of protrusions at the bottom of said side rack board 70, and two holes 501 being set on the desk board 50 under said side rack board 70; when said side rack board 70 being unfolded horizontally, said U-shape supporting stand 721 with both ends being inserted into said holes 501 to support the side rack board 70 horizontally on said desk board 50; further, said supporting structure as shown in FIGS. 2 and 5 having a hole preset on the bottom of said side rack board 71, and a hanger 731 pivotally passing through the ear plate 62 with a plurality of protrusions 621 at the bottom of the desk board above said side rack board 71; when said desk board 52 being unfolded horizontally, said hanger 731 swinging downward in a vertical position and having a hook section 733 facing upward and turning over in the direction from said side rack board 71 towards said hanger 731, such that the hook section 733 of the hanger 731 hooking into the hole 711 at the bottom of said side rack board 71, and said hanger 731 being hooked into said side rack board 71 and setting it in a horizontal position.

By means of the above structure, the computer desk is folded as shown in FIGS. 1 to 7; two side rack boards 70, 71 are folded and attached to their adjacent side frames 20, 30, and the U-shape supporting stand 721 also attaches to the bottom of the side rack board 70, and then all desk boards 50, 51, 52 are folded towards and attached onto the rear frame 10 outside the desk board 50, 51, 52 such that the whole computer desk is folded into a flat from. When the computer desk is unfolded as shown in FIGS. 1 to 7, the two side frames 20, 30 are unfolded outward to 90 degrees with respect to the rear frame 10, and then the desk boards 50, 51, 52 are turned over to the outside one by one to let their latches securely snap into the protruded ears 652, and then the two side rack boards 70, 71 are turned over so that the U-shape supporting stand 721 can provide the support or a hanger 731 can hang it.

The computer desk of this invention will be in a flat form after being folded, and allow a stable horizontal stacking in a flat carton for packaging to reduce spaces for storage and transportation. All structural parts and components of the computer desk are completely coupled with each other, and thus eliminating the trouble of disassembling the desk into several structural parts and then assembling them into a desk as in the prior art technology. Furthermore, the present invention can avoid any missing part in the package that makes the assembling impossible. The consumer buying this kind of computer desk no longer needs to take time and effort to assemble the desk, but just unfolds the desk for use, which is very simple and convenient.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. A foldable computer desk, comprising:

a rear frame, being a vertical frame;

two side frames, each with it's a bottom propped on the ground, and the rear of said frame pivotally coupled to said rear frame, such that said two side frames being folded to the front of said rear frame, and unfolded to the left and right sides in the front of said rear frame;

a plurality of desk boards with their rear ends pivotally coupled to said rear frame, such that said desk board being lifted and leaning against the front of said rear frame, and being unfolded horizontally between said two side frames;

a plurality of desk board supporting components, each disposed at an open end of the bottom thereof and said two side frames and said desk board being supported in a horizontal position when unfolded wherein said two side frames comprises a rear edge coupled to said rear frame with a plurality of movable axles; a rotary axle being disposed at said rear edge of said movable axle, and said movable axle having a rotary axle at said rear frame; and a clip plate with clippings from the top and the bottom at said side frame and the corresponding position of said rotary axle being movably coupled to both ends of said rotary axle.

2. The foldable computer desk of claim 1, wherein said two side frames comprises a rear edge coupled to said rear frame with a plurality of movable axles; a connecting plate being extended from said rear frame and the corresponding position of the rear end of said two side frames; and two connecting plates overlaying with each other and each having a penetrating axle.

3. The foldable computer desk of claim 1, wherein said rear frame and the rear edge of said desk board comprises two movable axles; said movable axle having an axle rod disposed on said rear frame and an ear plate disposed at the bottom of said desk board; and a hollow protrusion being disposed at the center of said ear plate for letting said axle rod pass through.

4. The foldable computer desk of claim 1, wherein said desk board supporting member comprises a latch at the bottom of said desk board, and a protruded ear at the side frame adjacent to said latch; said desk board being unfolded in a horizontal form, and said latch being snapped into said protruded ear.

5. The foldable computer desk of claim 5, wherein said latch of the desk board supporting member is latched inversely onto the bottom of the threaded section thereof.

6. The foldable computer desk of claim 1, wherein said supporting structure between said side rack board and desk board has a U-shape supporting stand pivotally coupled to the bottom of said side rack board; when the side rack board is unfolded, said U-shape supporting stand props the desk board under said rack board.

7. The foldable computer desk of claim 6, wherein said desk board under the side rack board has two holes, and said side rack board is unfolded horizontally, and the bottom ends of said U-shape supporting stand are inserted into said two holes.

8. The foldable computer desk of claim 6, wherein said side rack has a plurality of ear plates at its bottom, and said ear plate has a hollow protrusion at its center for letting a rotary rod body of said U-shape supporting stand pass through.

9. The foldable computer desk of claim 1, wherein said supporting structure between said side rack board and desk board has a movable hanger disposed at the bottom of the desk board above said side rack board, and the open end of said hanger supports the bottom of said side rack board.

10. The foldable computer desk of claim 9, wherein said side rack board has a hole at its bottom, and the open end of said hanger has a hook; when said desk board and said side rack board are unfolded horizontally, said hanger latches its hook into said hole.

11. The foldable computer desk of claim 10, wherein said desk board has a plurality of ear plates at its bottom, each ear plate at its center has a protrusion for letting a rotary rod body of said hanger pass through.

12. The foldable computer desk of claim 1, wherein said desk board at the center of the desk has a keyboard tray capable of moving back and forth under the desk.

13. A foldable computer desk, comprising:

a rear frame, being a vertical frame;

two side frames, each with it's a bottom propped on the ground, and the rear of said frame pivotally coupled to said rear frame, such that said two side frames being folded to the front of said rear frame, and unfolded to the left and right sides in the front of said rear frame;

a plurality of desk boards with their rear ends pivotally coupled to said rear frame, such that said desk board being lifted and leaning against the front of said rear frame, and being unfolded horizontally between said two side frames;

a plurality of desk board supporting components, each disposed at an open end of the bottom thereof and said two side frames and said desk board being supported in a horizontal position when unfolded further comprising:

a plurality of side rack boards, each having its end pivotally coupled said two side frames such that said side rack board being lifted and leaning against said two side frames, and unfolded horizontally between said desk boards, and a supporting structure being disposed between the unfolded side rack board and its adjacent desk board wherein said structure is pivotally coupled to said side rack board and said two side frames comprises a transversal rod on said two side frames, a plurality of ear plates at the bottom of said rack board; and a hollow protrusion at the center of said ear plate for letting said transversal rod pass through.

* * * * *